US009163823B2

(12) United States Patent
Choksi et al.

(10) Patent No.: US 9,163,823 B2
(45) Date of Patent: Oct. 20, 2015

(54) LIGHT MODULE

(71) Applicant: Black & Decker Inc., Newark, DE (US)

(72) Inventors: Snehal S. Choksi, Owings Mills, MD (US); James B. Watson, Baltimore, MD (US); Fred S. Watts, New Freedom, PA (US); Andrzej R. Wojcicki, Rosedale, MD (US); Gabriel Concari, Eldersburg, MD (US); Leon T. Gibson, Randallstown, MD (US); James P. Bascom, Bel Air, MD (US)

(73) Assignee: Black & Decker Inc., Newark, DE (US)

( * ) Notice: Subject to any disclaimer, the term of this patent is extended or adjusted under 35 U.S.C. 154(b) by 73 days.

(21) Appl. No.: 13/857,268

(22) Filed: Apr. 5, 2013

(65) Prior Publication Data

US 2013/0265766 A1 Oct. 10, 2013

Related U.S. Application Data

(63) Continuation of application No. 13/839,120, filed on Mar. 15, 2013.

(60) Provisional application No. 61/620,702, filed on Apr. 5, 2012.

(51) Int. Cl.

| | |
|---|---|
| ***F21V 29/76*** | (2015.01) |
| ***F21V 29/00*** | (2015.01) |
| ***F21V 21/14*** | (2006.01) |
| ***F21V 21/22*** | (2006.01) |
| ***F21S 8/08*** | (2006.01) |
| ***F21V 21/10*** | (2006.01) |
| *F21V 17/08* | (2006.01) |
| *F21V 21/116* | (2006.01) |
| *F21Y 101/02* | (2006.01) |
| *F21V 21/06* | (2006.01) |

(Continued)

(52) U.S. Cl.

CPC ..... *F21V 29/2206* (2013.01); *F21S 8/081* (2013.01); *F21V 21/10* (2013.01); *F21V 21/145* (2013.01); *F21V 21/22* (2013.01); *F21V 17/08* (2013.01); *F21V 21/06* (2013.01); *F21V 21/116* (2013.01); *F21V 23/002* (2013.01); *F21V 23/009* (2013.01); *F21V 23/02* (2013.01); *F21V 29/76* (2015.01); *F21W 2131/1005* (2013.01); *F21Y 2101/02* (2013.01)

(58) Field of Classification Search

CPC ... F21V 15/011; F21V 15/012; F21V 19/001; F21V 19/0035; F21V 21/00; F21V 23/023; F21V 29/02; F21V 29/22; F21V 29/2206; F21V 29/2212; F21V 29/2218

USPC ..... 362/249.01, 249.02, 294, 373, 368, 431

See application file for complete search history.

(56) References Cited

U.S. PATENT DOCUMENTS

| | | | |
|---|---|---|---|
| 6,474,844 | B1 | 11/2002 | Ching |
| 7,195,377 | B2 | 3/2007 | Tsai |

(Continued)

*Primary Examiner* — Julie Bannan

(74) *Attorney, Agent, or Firm* — Amir R. Rohani; Scott Markow

(57) ABSTRACT

A light stand assembly with a base having pivoting legs and a power supply circuit. An adjustable post detachably connects to the base. The adjustable post is configured for telescoping movement between a lower position and a raised position, and secures at a selected position with latches. An adjustable post connector moveably connects to the adjustable post. A pair of light modules detachably connect to the adjustable post connector and operatively connects to the power supply circuit.

18 Claims, 16 Drawing Sheets

(51) Int. Cl.

| | |
|---|---|
| *F21V 23/00* | (2015.01) |
| *F21V 23/02* | (2006.01) |
| *F21W 131/10* | (2006.01) |

(56) References Cited

U.S. PATENT DOCUMENTS

| | | | | |
|---|---|---|---|---|
| 7,387,412 | B2 | 6/2008 | Tsai | |
| 7,784,971 | B2 * | 8/2010 | Dorogi | 362/294 |
| 8,038,330 | B2 | 10/2011 | Liu | |
| 8,310,177 | B2 | 11/2012 | Naumann et al. | |
| 8,376,569 | B2 | 2/2013 | Pelletier et al. | |
| 8,383,263 | B2 | 2/2013 | Cruise et al. | |
| 2006/0146553 | A1 * | 7/2006 | Zeng et al. | 362/488 |
| 2008/0278941 | A1 * | 11/2008 | Logan et al. | 362/234 |
| 2009/0161224 | A1 | 6/2009 | Hauschild et al. | |
| 2010/0044589 | A1 * | 2/2010 | Garcia et al. | 250/492.1 |
| 2010/0314985 | A1 * | 12/2010 | Premysler | 313/46 |
| 2010/0328962 | A1 | 12/2010 | Liu | |
| 2011/0089838 | A1 * | 4/2011 | Pickard et al. | 315/113 |
| 2011/0273881 | A1 * | 11/2011 | Domagala et al. | 362/235 |
| 2012/0113636 | A1 | 5/2012 | Klipstein et al. | |
| 2012/0326670 | A1 | 12/2012 | Shook et al. | |
| 2013/0008682 | A1 | 1/2013 | Turner et al. | |
| 2013/0017706 | A1 | 1/2013 | Million | |

* cited by examiner

LIGHT MODULE

CROSS-REFERENCE TO RELATED APPLICATIONS

This application is a continuation of U.S. patent application Ser. No. 13/839,120 filed on Mar. 15, 2013, which claims priority to U.S. Provisional Application Ser. No. 61/620,702 filed Apr. 5, 2012. The disclosures of the above applications are incorporated herein by reference in their entirety.

BACKGROUND

The present invention relates to a light module and light stand assembly, and specifically to a light stand with adjustable and replaceable light modules.

Construction and home improvement projects that occur at night or in unlighted areas require artificial lighting. Depending on the location, conditions, and various other factors, each project can have vastly different lighting requirements, such as different brightness, power, and position of the lights. In fact, a single location may have different requirements at different times during the project as conditions change.

Various light devices have been developed to provide lighting for different conditions. However, each of these devices has limitations and drawbacks. Many light devices require some assembly and disassembly before and after use. Other devices are limited by their lack of flexibility or adjustability, which prevents them from accommodating many of the various heights, positions, and locations that can occur during a project. In addition, existing light devices typically require a power source, such as a power outlet, which significantly limits the mobility and use of the light device in many areas.

Existing light devices typically use incandescent, fluorescent, or halogen lighting, which all have drawbacks. Incandescent work lights break easily in a work environment when dropped or knocked down and create a safety hazard. Upon breaking, the exposure of the filament can ignite flammable materials, and this often results in breakage of the bulb or its filament. Fluorescent lights have greater energy efficiency and a reduced hazard of igniting flammable materials if they break. However, fluorescent lights can generally break just as easily. Halogen lights are bright, efficient, and long lasting. On the other hand, their high operating temperature make them an increased safety hazard around flammable materials. In addition, they can malfunction if exposed to moisture or oils, such as oils from human skin.

Therefore, a light stand assembly is needed that is flexible, adjustable, and easily transported.

SUMMARY

Briefly stated, the invention is a light stand assembly with a base that houses a power supply circuit. An adjustable post detachably connects to the base. The adjustable post is configured for movement between a lowered position and a raised position, and secures at a selected position. An adjustable post connector moveably connects to the adjustable post. A light module detachably connects to the adjustable post connector and operatively connects to the power supply circuit.

The foregoing and other features, and advantages of the disclosure as well as embodiments thereof will become more apparent from the reading of the following description in connection with the accompanying drawings.

DESCRIPTION OF THE DRAWINGS

In the accompanying drawings which form part of the specification.

Corresponding reference numerals indicate corresponding parts throughout the several figures of the drawings.

DETAILED DESCRIPTION

Figure 1:
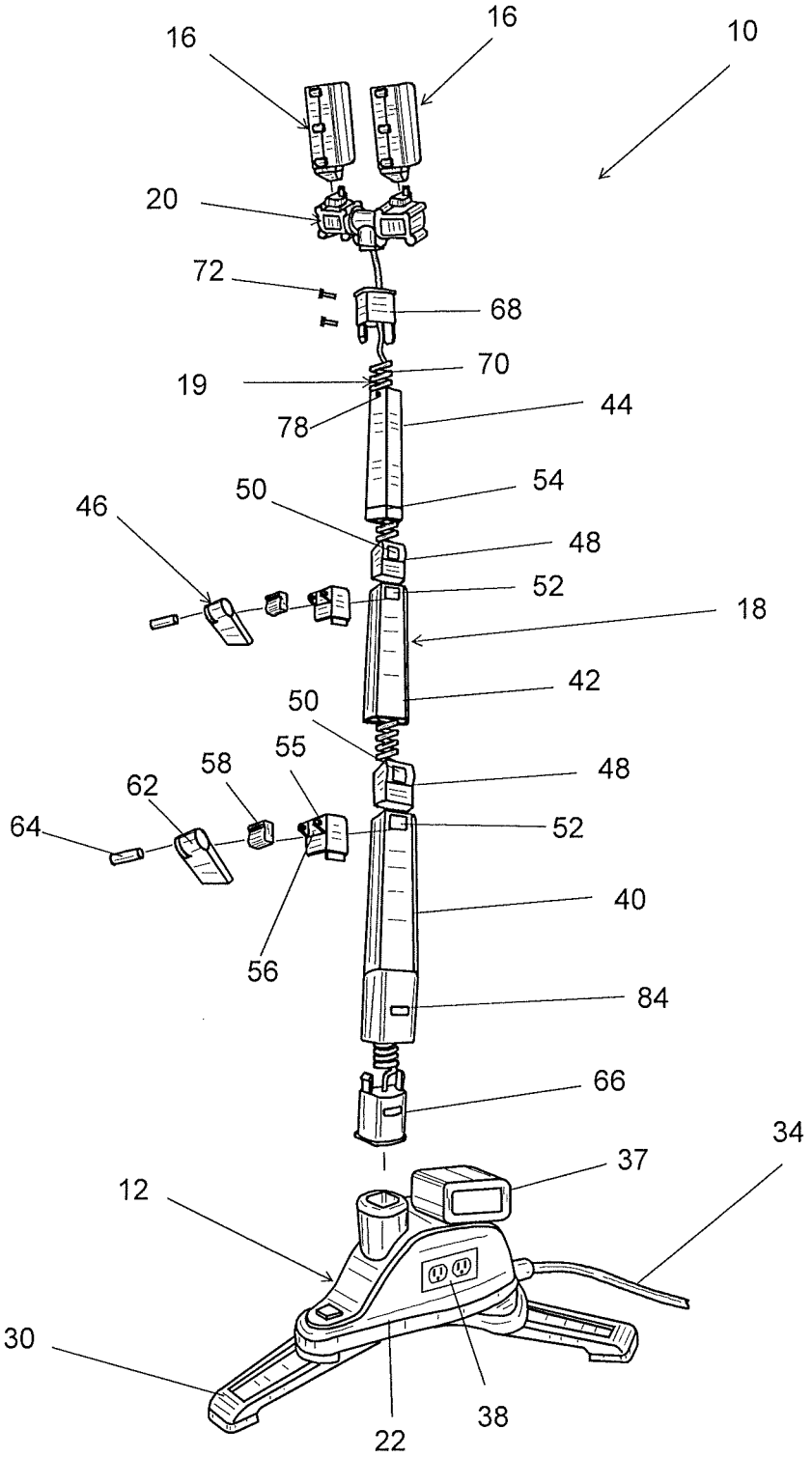
FIG. 1 is an exploded perspective view of a light stand assembly, in accordance with the present invention.

The following detailed description illustrates the claimed invention by way of example and not by way of limitation. The description clearly enables one skilled in the art to make and use the claimed invention, describes several embodiments, adaptations, variations, alternatives, and uses of the claimed invention, including what is presently believed to be the best mode of carrying out the claimed invention. Additionally, it is to be understood that the claimed invention is not limited in its application to the details of construction and the arrangements of components set forth in the following description or illustrated in the drawings. The claimed invention is capable of other embodiments and of being practiced or being carried out in various ways. Also, it is to be understood that the phraseology and terminology used herein is for the purpose of description and should not be regarded as limiting.

As shown in FIGS. 1-18, a light stand assembly 10, includes a base assembly 12 having a power supply circuit 14 operatively connected to a pair of light modules 16. An adjustable post assembly 18 attaches to the base assembly 12 and is configured for variable movement and securement of the light modules 16 between a lowered position (FIG. 2), a raised position (FIG. 3), and any position in between. An adjustable post connector 20 attaches to the upper end of the post assembly 18, and is configured for detachable connection with the light modules 16.

Figure 2:
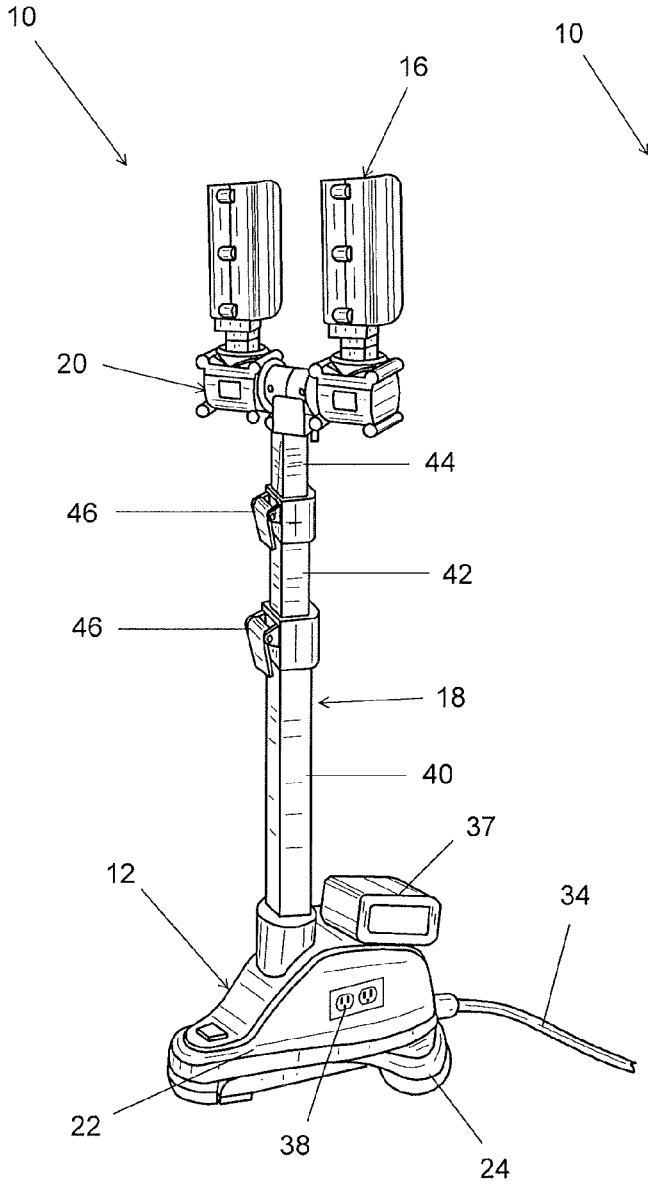
FIG. 2 is a perspective view of the light stand assembly in a lowered position with legs in a storage position, in accordance with the present invention.
Figure 3:
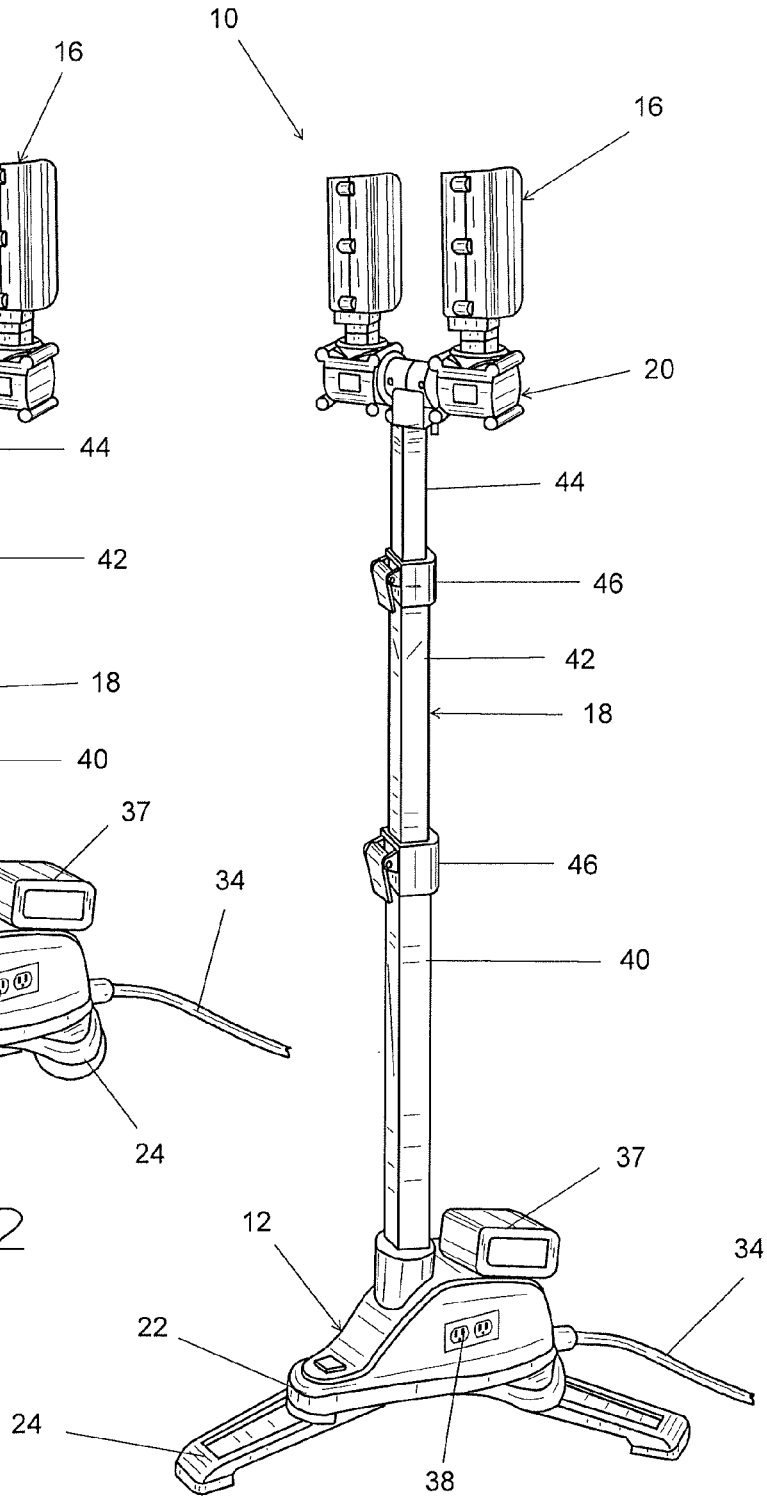
FIG. 3 is a perspective view of the light stand assembly in a raised position with legs in an open position, in accordance with the present invention.
Figures 4, 4A:
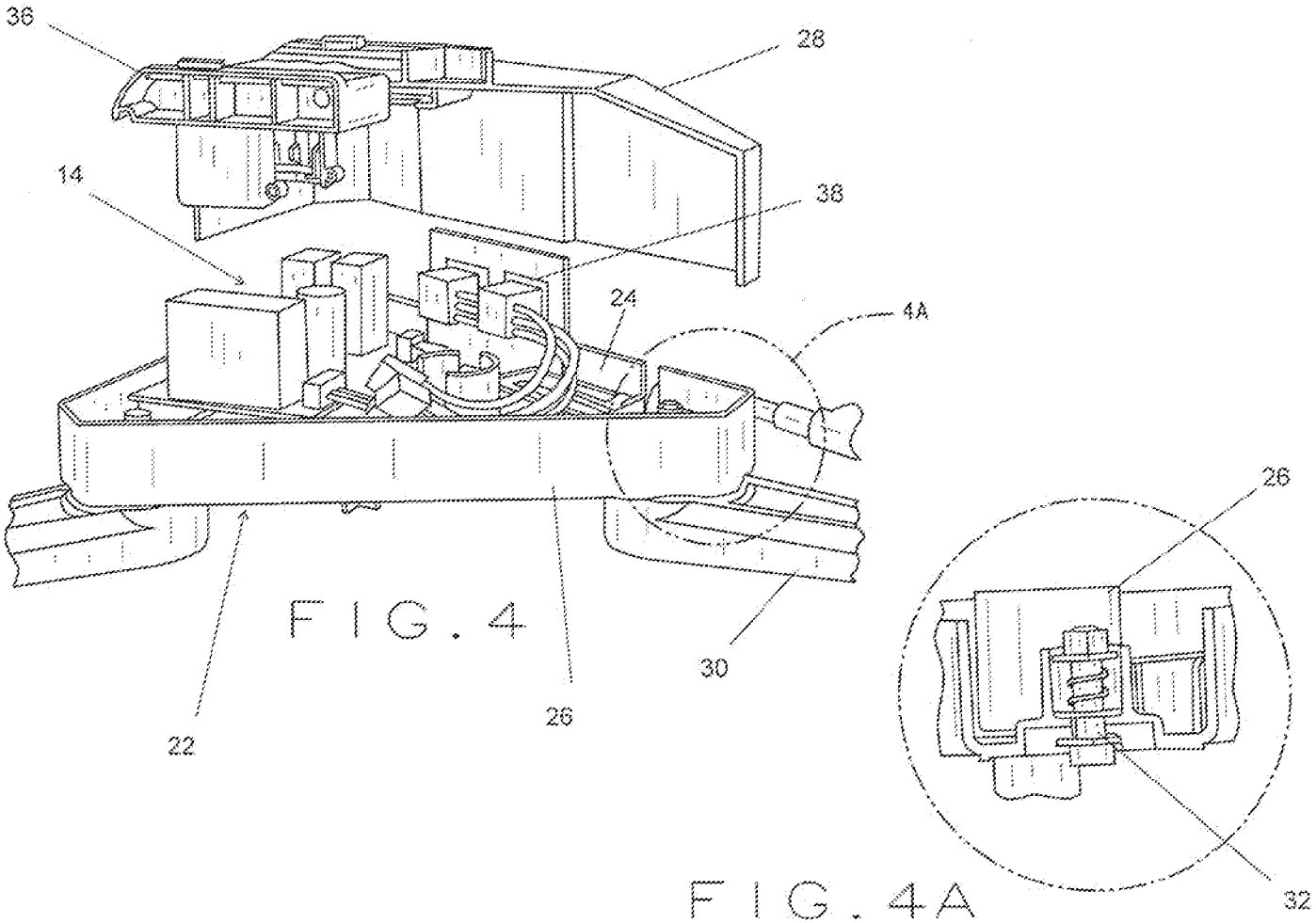
FIG. 4 is a perspective view of a base of the light stand assembly with one of the covers removed, in accordance with the present invention.
FIG. 4A is an enlarged section view of a leg connection to the base, in accordance with the present invention.
Figure 5:
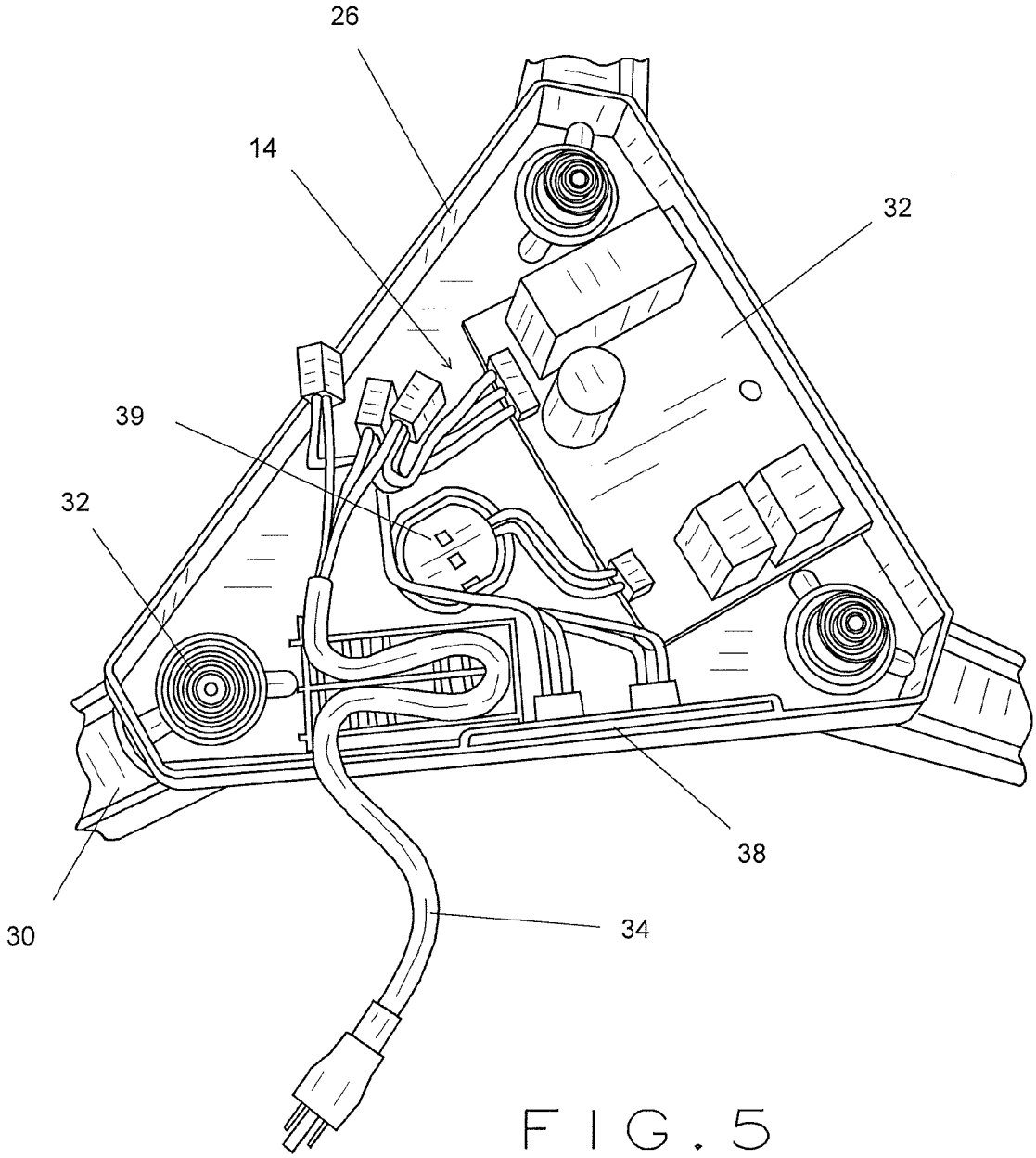
FIG. 5 is an overhead perspective view of the base with the covers removed, in accordance with the present invention.

As shown in FIGS. 4-5, the base assembly 12 includes a generally trapezoidal prism shaped housing 22 having a plurality of moveable legs 30 that move between a storage position (FIG. 2) and an open position (FIG. 3). The housing 22 defines a compartment 24 for accommodating the power supply circuit 14.

The housing 22 includes a generally triangular-shaped bottom member 26 that couples with a pair of covers 28. Each leg 30 pivotally attaches at about each corner of the bottom member 26, such as with fasteners 32. In the open position, the legs 30 extend generally outwardly to enhance stability of the light stand assembly 10. In the storage position, the legs 30 extend generally inwardly to reduce the footprint of the base 12 for easier storage. If desired, a locking mechanism, such as corresponding detents and recesses, can be used to prevent or reduce the chance of accidental movement of the legs 30 between positions.

The power supply circuit 14 includes electrical components to receive electric power from a plurality of power sources, including Alternating Current (AC) and/or Direct Current (DC) power sources. These electrical components include a printed circuit board 32 mounted to the bottom member 26 of the housing 22 and operatively connected to a power cord 34 for connection to an AC power source (FIG. 5). The circuit board 32 also operatively connects to a battery interface 36 which mounts to the covers 28 for connection to a DC power source, such as a battery. For example, the battery interface 36 can be a sliding battery receptacle configured to receive and lock in a sliding battery pack, as disclosed in U.S. Design Pat. No. D432,077, assigned to Black & Decker Inc., hereby incorporated by reference. Alternatively or additionally, the battery interface may be configured to receive and lock in a tower battery pack, as disclosed in U.S. Patent Publication No. US2010/0273031 by Black & Decker Inc., hereby incorporated by reference. However, those skilled in the art will recognize that the base assembly 12 and power supply circuit 14 can include any suitable input and output receptacles based on global requirements provided along with the necessary wire up connectors.

In addition, the power supply circuit 14 can output electrical power to electrical components, such as power outlets 38 and the light modules 16. A base terminal connector 39, such as a female plug receptacle, mounted to the bottom member 26 is configured for operatively connecting to an electric circuit 19 of the post assembly 18 for communicating electrical power from the power supply circuit 14 to the light modules 16.

The power supply circuit 14 can also include various convertors, preferably an AC-to-DC converter to convert AC power to, for example, a 25V 1.5 A constant voltage DC power supply. However, other convertors can be used, such as a DC-to-DC converter.

In alternate embodiments, the power supply circuit 14 can include AC or DC power outlets, battery chargers, USB, ports, cigarette light receptacle, and the like. For example, the power supply circuit 14 may include electrical components to permit charging of other electronics. For example, the power supply circuit could charge batteries 37 plugged into the battery interface 36 when the AC power cord 34 is plugged in.

The post assembly 18 includes a lower tube 40, a middle tube 42, and an upper tube 44 in a nesting arrangement that allows the tubes 40, 42, and 44 to extend and retract between the collapsed or lowered position (FIG. 2) and the extended or raised position (FIG. 3). Latches 46 operatively engage the tubes 40, 42, 44, for securement and release in selected positions. In the lowered position, the pole assembly 18 is preferably about two feet in length. In the raised position, the pole assembly 18 is preferably about five feet in length. However, those skilled in the art will recognize that any suitable length can be used.

Each tube 40, 42, and 44 has a generally hollow trapezoid-shaped cross-section, however, any suitable shape can be used, including, but not limited to square, circular, rectilinear, or non-linear shape. The width of each tube 40, 42, and 44 generally tapers or narrows from the lower end to the upper end. A pair of sleeves 48 insert into respective upper ends of the lower tube 40 and middle tube 42 and secure against the inner surfaces, such as with a friction fit. For engagement with the latches 46, each sleeve 48 defines a generally square opening 50 that aligns with a corresponding opening 52 in respective lower tube 40 and middle tube 42. A collar 54 attaches to the outer surface of the upper tube 44 at about the lower end, such as with a friction fit.

To assemble into the nesting arrangement, the upper tube 44 inserts into the lower end of the middle tube 46, and slides upwardly through the upper end of the middle tube 46. The collar 54 seats against the sleeve 48 to prevent the upper tube 44 from sliding completely through the upper end of the middle tube 42. Next, the upper tube 46 and middle tube 44 insert into the lower end of the lower tube 42, and slide upwardly through the upper end of the lower tube 42. The lower end of the middle tube 42 seats against the sleeve 48 to prevent the middle tube 42 from sliding completely through the upper end of the middle tube 42.

Each latch 46 includes a collar 55 sized to slide over the respective tube 40 and 42. The collar 55 defines an opening 56 that aligns with tube openings 52, and sleeve openings 50. A generally rectangular saddle 58 inserts into openings 50, 52, and 56. Hinges 60 positioned on either side of the saddle 58 are configured to receive a lever 62, which is secured with a pin 64. The lever 62 pivots about the pin 64 between a locked position and an unlocked position. In the locked position, the lever 62 presses downwardly on the saddle 58 until it seats against the respective middle tube 42 or upper tube 44 for securement in the selected position. In the unlocked position, the lever releases the saddle 58 until it unseats from the respective middle tube 42 or upper tube 44 for movement to a selected position. Although FIGS. 1-3 show the latch 46 as a flip-lock or clamp style, any suitable type of latch can be used, such as twist-lock, a cam mechanism, a locking collar or a push button actuated lever, or snap lock.

The post assembly 18 includes the electrical circuit 19 for communicating power from the power supply circuit 14 to the post connector 18 and the light modules 16. The post electrical circuit 19 includes a lower terminal connector 66 operatively connected to an upper terminal connector 68 with a wiring harness 70. The lower terminal connector 66 is configured for detachable connection with the base terminal connector 39 of the power supply circuit 14.

Figure 6:
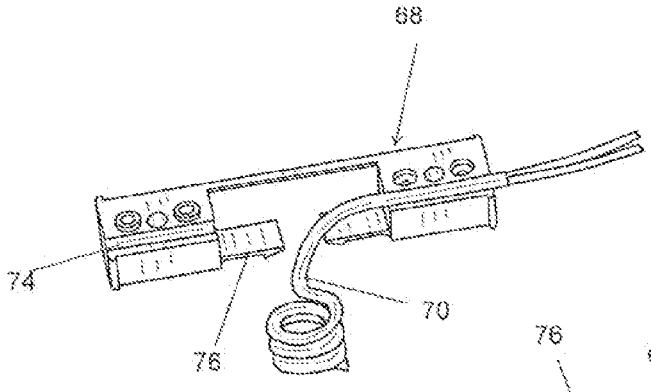
FIG. 6 is a perspective view of a upper terminal connector in an open position, in accordance with the present invention.
Figure 7:
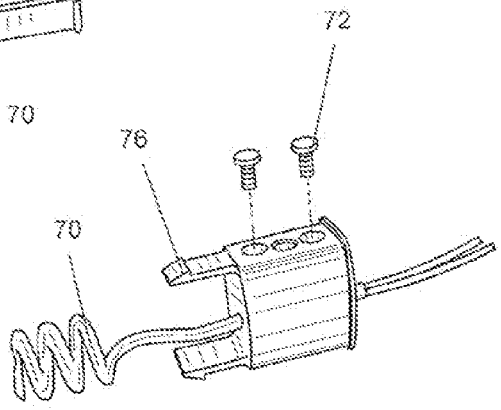
FIG. 7 is a perspective view of the upper terminal connector in a closed position and coupled with a wire, in accordance with the present invention.

As shown in FIGS. 6-7, the upper terminal connector 68 includes two halves that when assembled, such as secured with fasteners 72, form a generally rectangular block that defines a channel 74 for receiving the wiring harness 70. A pair of detents 76 extend from a lower portion of the block for engagement with corresponding holes 78 of the upper tube 44. The lower terminal connector 66 also includes two halves that when assembled, such as secured with fasteners 76, form a generally rectangular block that defines a slot 78 for receiving a male plug 80, which operatively connects to the wiring harness 70. The male plug 80 is configured for mating with the base terminal connector 39 of the power supply circuit 14. A pair of detents 82 extend from an upper portion of the block for engagement with corresponding holes 84 of the lower tube 42. The wiring harness 70 is preferably a coiled cable, similar to those used in conventional telephones, however, any suitable type of wire or electrical connection can be used that accommodates the extension and retraction of the post assembly 18 between the lowered position and the raised position.

The post connecter 20 includes a T-member 86 with a pair of elbows 88 pivotally attached to the left and right branches. A terminal connector 90 pivotally attaches to each elbow 88 for detachable connection with the light modules 16. The terminal connector 90 operatively connects to a circuit board 98, a pair of on/off switches 94 and the upper terminal connector 68 of the post assembly 18.

The T-member 86 includes two halves that when assembled, such as with fasteners 96, define a compartment for mounting a control unit or circuit board 98. The control unit 98 monitors and control the voltage provided to the light modules 16. The middle branch 100 is adapted for attaching to the upper end of the post assembly 18, such as with a fastener 102. The left and rights branches 104 are generally annular and terminate in a flange 106. Gaskets 108 or o-rings seat within channels on the branches. The pivotal movement of the elbows 88 provide for adjustable positioning of the light modules 16.

Each elbow 88 includes two halves that assemble, such as with fasteners, for engagement with the flange 106 and gasket 108 of a respective branch 104 for pivotal movement. Each elbow defines a bore 110 for receipt of the terminal connector 90. Each terminal connector 90 is generally cylindrical with an annular portion 111 with seated gaskets or o-rings that pivotally engages the bore 110 of a respective elbow 88. The opposite end of the terminal connector 90 is a generally rectangular portion 113 with connectors 112, such as spring type connector, for detachably mating with the light modules 16. However, any type of connector can be used. The pivotal movement of the terminal connector 90 provides for further adjustable positioning of the light modules 16.

As shown in FIGS. 15-18, the light module 16 includes a generally triangular prism shaped housing 114 that defines a chamber 116 configured for mounting a heat sink 118, a light 120, a light cover 122, a convertor 124, and a light interface 126.

The housing 114 separates into a first section 128 and a second section 130. Each section defines an opening 131 to expose the heat sink 118 to the surrounding atmosphere for cooling purposes. The first section 128 and second section 130 define notches 132 that mate when assembled to form a generally rectangular opening to receive the light cover 122. The light cover 122 is a translucent pane, such as tempered glass, mounted within a bezel 134. However, any suitable translucent material can be used. The outer surface of the housing 114 includes a grip enhancing pattern 136 to enhance the user's ability to grip the light module 16. The bottom of the housing defines a bore 138 adapted for receipt of a light interface 140 that detachably couples with the post connector 20. The housing 114 is preferably made from a material with thermal insulating properties, such as plastic, but any suitable material can be used. For example, the bezel design could also be a single piece plastic component molded from lens quality materials to enhance durability while maintaining clarity.

The heat sink 118 is generally a triangular prism shape having cooling fins 142 extending the length of two sides. A pair of generally planar mounting surfaces 144 and 146 also extend the length of the heat sink 118 for mounting the light 120 and convertor 124. In embodiment of FIGS. 15-18, the heat sink 118 preferably is a size of about 130 mm×50 mm×57 mm, and weighs about 375 g. However, those skilled in the art will recognize that the heat sink 118 can be configured in any shape and size that meets the regulatory agency thermal thresholds related to direct touch of metals by users, for example, that operating temperatures are within the acceptable 60° C. maximum requirements.

The light 120 is a printed circuit board having a plurality of light emitting diodes (LED). The light 120 mounts to the mounting surface 144 using any suitable method, including, but not limited to, adhesive, soldering, or fastening. Preferably, the light 120 has an output range of about 1500 Lumens to about 1800 Lumens, however any suitable range can be used.

The convertor 124 is a printed circuit board with various electrical components, including a DC-to-DC convertor. In operation, the DC-to-DC converter receives constant-voltage DC power through the post connector from the power supply and converts it to constant-current DC power. Constant-current power is required to drive the LED board light. If desired, the DC-to-DC converter may also include a pulse width modulation (PWM) controller or other circuitry to realize a dimming function, whereby the current output is controlled to achieve a desired light output level.

The convertor 124 mounts to the mounting surface 144 preferably using a thermally-conductive but electrically-insulating tape 147 and is operatively connected to the light 120, such as with a flexible pad having conductive routings. The tape 147 protects the convertor circuit board from electric shortage with the heat sink 118 while providing thermal conductivity with the heat sink 118. However, any suitable method can be used, including, but not limited to, adhesive, soldering, or fastening. The convertor 124 is operatively connected to the post connector 20.

Figure 25:
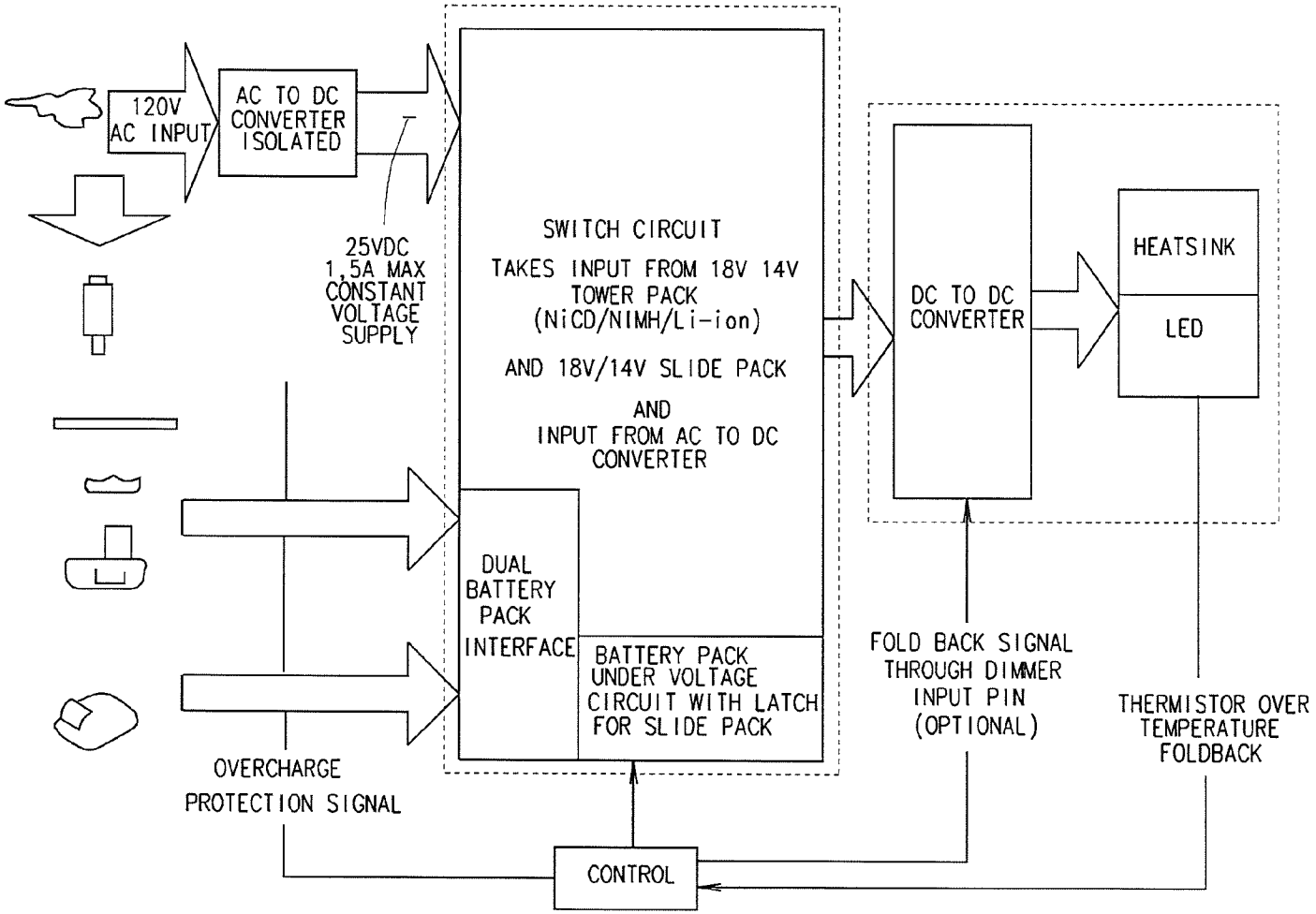
FIG. 25 is a block diagram illustrating the power supply circuit, in accordance with the present invention.

FIG. 25 is a block diagram showing the operation of the power supply circuit 14 and the light modules 16. As discussed above, the power supply circuit 14 may receive AC power from an AC power source. In that case, the AC power source is coupled to an AC-to-DC converter of the power supply circuit 14. The AC-to-DC converter may convert, for example, a 120V AC power supply to a 25V, 1.5 A max constant voltage DC power supply. The power supply circuit 14 may also receive DC power from a variety of supplies such as a tower battery pack, a sliding battery pack, an automobile battery power supply, etc. For example, both the tower battery pack and the sliding battery pack provide 14V to 18V of constant-voltage power. The power supply circuit 14 may include separate battery interfaces for the different types of battery packs. Alternatively, the power supply circuit 14 may include a dual battery pack interface.

The power supply circuit 14 may also include a switch circuit, e.g. a multiplexer. The multiplexer receives inputs from the AC-to-DC converter, the sliding battery pack interface, and the tower battery pack interface, and outputs a single DC power supply to the light module 16.

Figure 26:
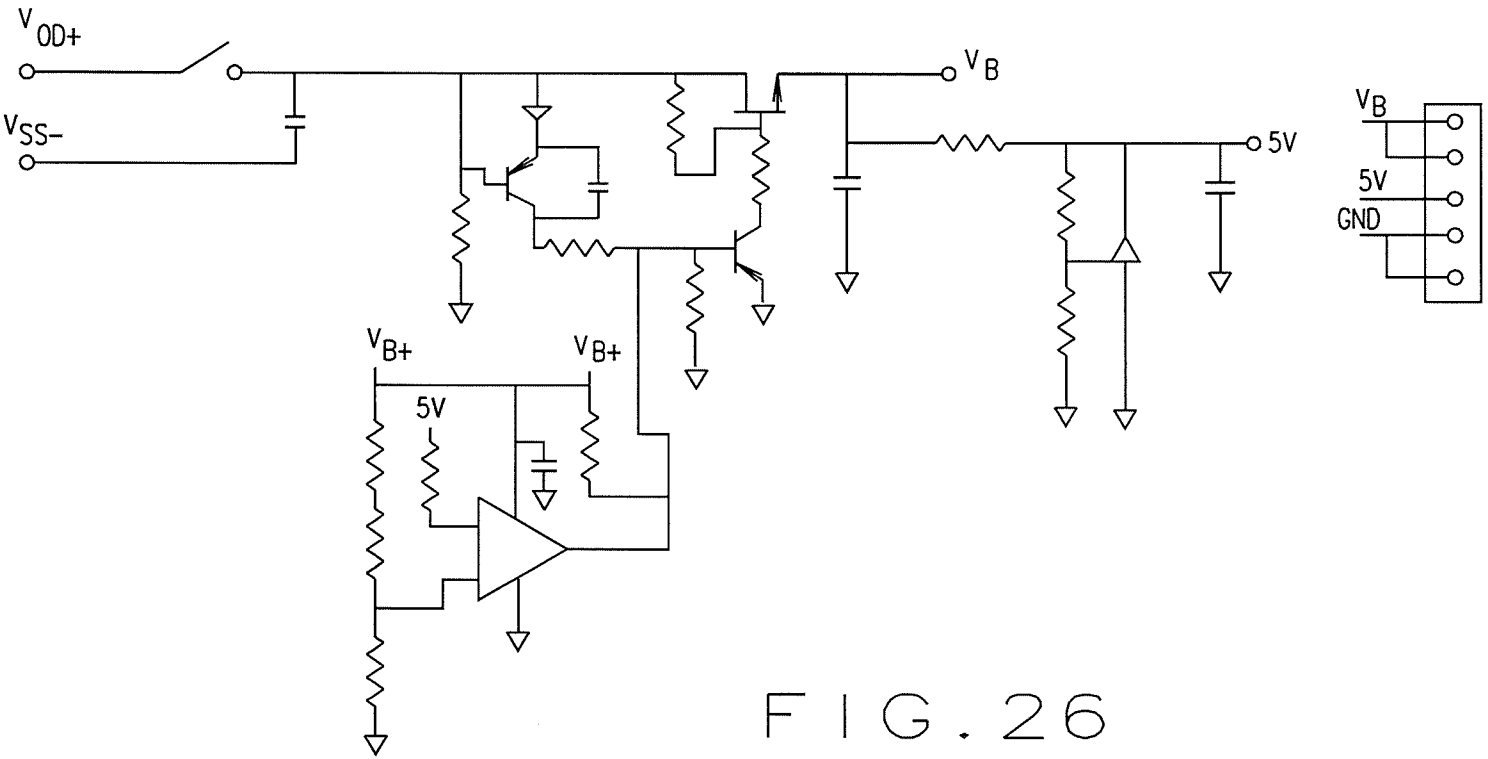
FIG. 26 is a schematic of an undervoltage latch circuit in accordance with the present invention.

Some existing battery packs may include a microcontroller or other control circuitry that control different aspects of the battery charge/discharge operations. In such "smart" battery pack, the controller may be configured to detect and control conditions such as under-voltage, over-temperature, etc. and shut down or slow down the output of battery power accordingly. Other battery packs, however, may be provided without a controller. Therefore, the power supply circuit 14 can include circuitry to provide intelligence for controlling the operation of the battery pack. In one embodiment, the power supply circuit includes an undervoltage monitoring and latch circuit 150 (FIG. 26) that monitors the battery pack voltage and shuts down the supply of power from the battery pack if the battery pack.

Figure 27:
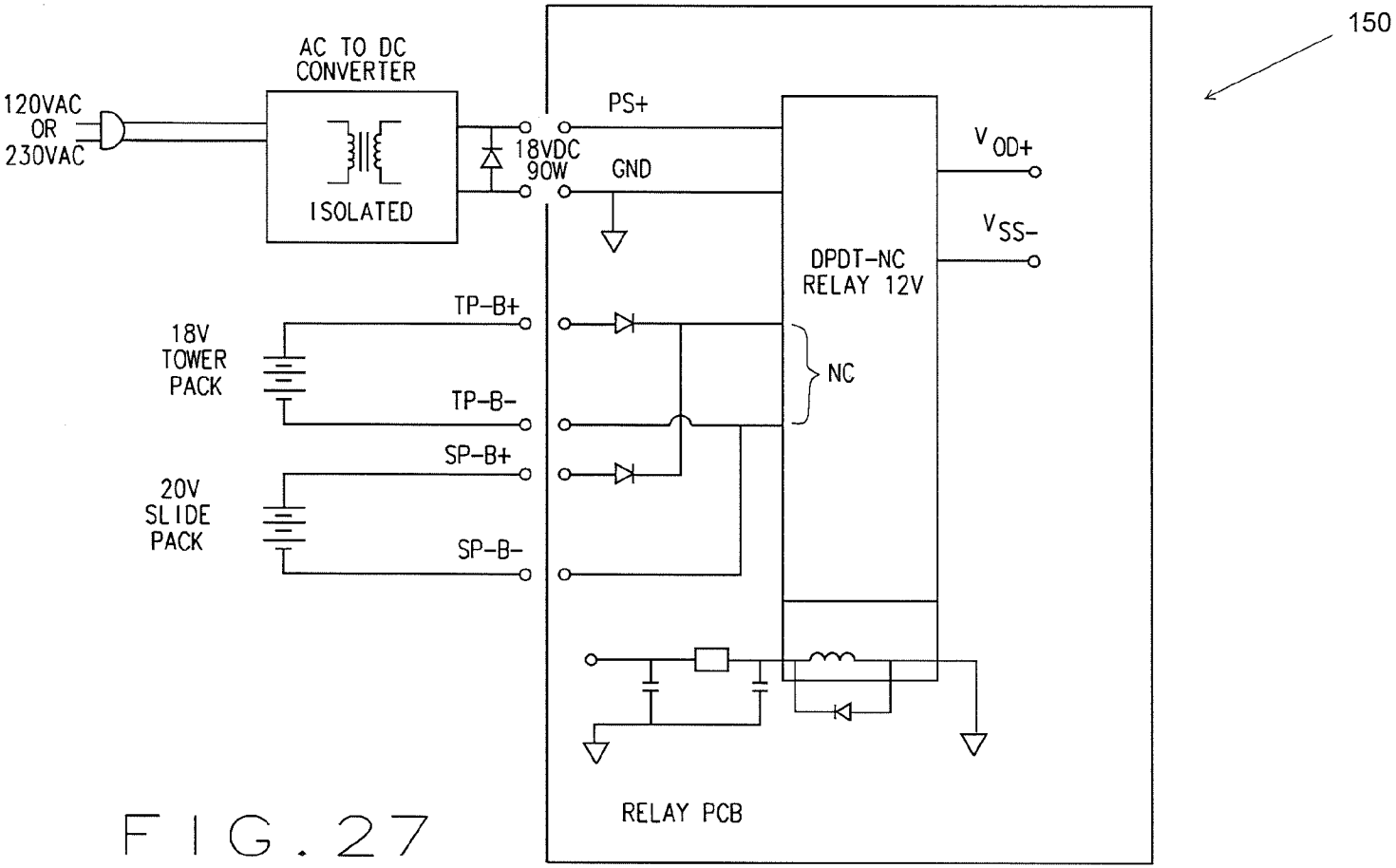
FIG. 27 is a schematic of a relay multiplexer circuit in accordance with the present invention.

The undervoltage latch circuit 150 receives power from output of multiplexer circuit (FIG. 27), and includes a switch S1 to shut down the supply of power from the multiplexer circuit. The circuit allows the switch S1 to remain ON if battery power remains above a predetermined threshold, in this case 9 VDC. If the voltage falls below 9V, the supply voltage will be cut off and latched. In other words, the switch S1 can only be reset if the ON/OFF switch is turned off and on and the battery voltage is higher than 9 VDC. The latch circuit 150 provides a constant voltage of 5V to the light module.

Referring back to FIG. 25, the light module 16 receives constant-voltage DC power from the power supply circuit 14 for powering the LED light 120. However, since the LED light 120 requires constant-current power to drive the LED, the light module 16 includes a DC-to-DC converter that converters the constant-voltage power to constant-current power.

The control unit 98 monitors and controls the voltage provided to the light modules 16. The control unit 98 may be, for example, a programmable microcontroller. Although in this example the control unit 98 is provided within the post connector 20, it is noted that the control unit 98 can be provided in the base member 12 or other parts of the light stand, or even within the light module housing as well. The control unit 98 discussed herein may perform a variety of functions, including having a thermal control unit to handle thermal management of the LED board.

Heat has adverse effect on the life of the LEDs; thus, ensuring that the temperature of the LED board is kept below a certain threshold is important. Thus, the control unit 98 is coupled to a thermistor within the light module 16 that provides the control unit 98 with temperature information of the LED board. If the direct or indirect temperature of the LED chip, the LED board and/or the heat sink is above a certain predetermined threshold of, for example, 90° C., thermal monitor unit of the control unit 98 may immediately shut down the supply of power via an enable signal to the light stand switch circuit. Alternatively, the thermal monitor unit may enter a thermal fold back mode, in which the current provided to the LED is reduced, thereby "dimming" the LED lights. This thermal monitor unit may continue to monitor the light module temperature and modify the rate of fold back as needed. For example, if the temperature continues to rise, the thermal monitor unit may decrease the flow of current at a faster rate and even shut down the supply of power to the light module 16. It is noted that in addition to monitoring the temperature of the light module 16, the control unit may also monitor the temperature of various other components (i.e., the base member or the head portion) and similarly shut down or fold back the current when the temperature is too high.

The control unit 98 may further monitor the average current delivered to the LED light 120 and shut down the supply of power in the event of an overcharge condition (e.g., if is a sudden spike in current). The control unit 98 may also monitor the voltage level of the power supply and shut down the supply of power in the event of an over-voltage condition (i.e., if the power supply is above a certain voltage threshold). The control unit 98 may further be configured to enable or disable the light module base on detection of other fault condition.

Figure 8:
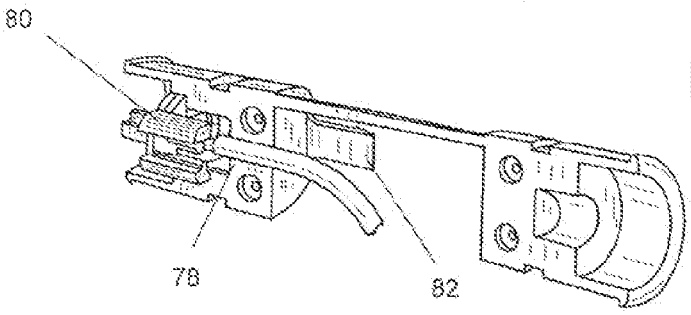
FIG. 8 is a perspective view of a lower terminal connector in an open position, in accordance with the present invention.
Figure 9:
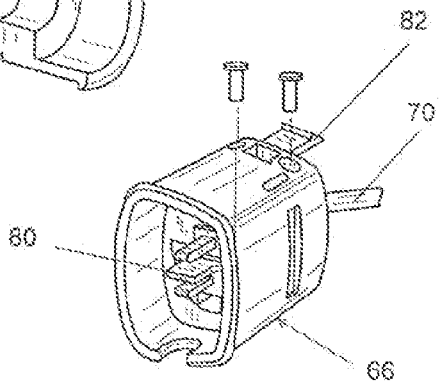
FIG. 9 is a perspective view of the lower terminal connector in a closed position and coupled with a male socket connector, in accordance with the present invention.
Figure 10:
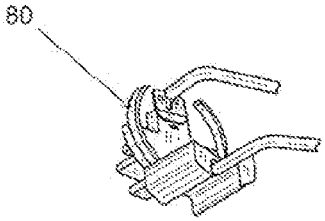
FIG. 10 is a perspective view of the male socket connector, in accordance with the present invention.
Figure 11:
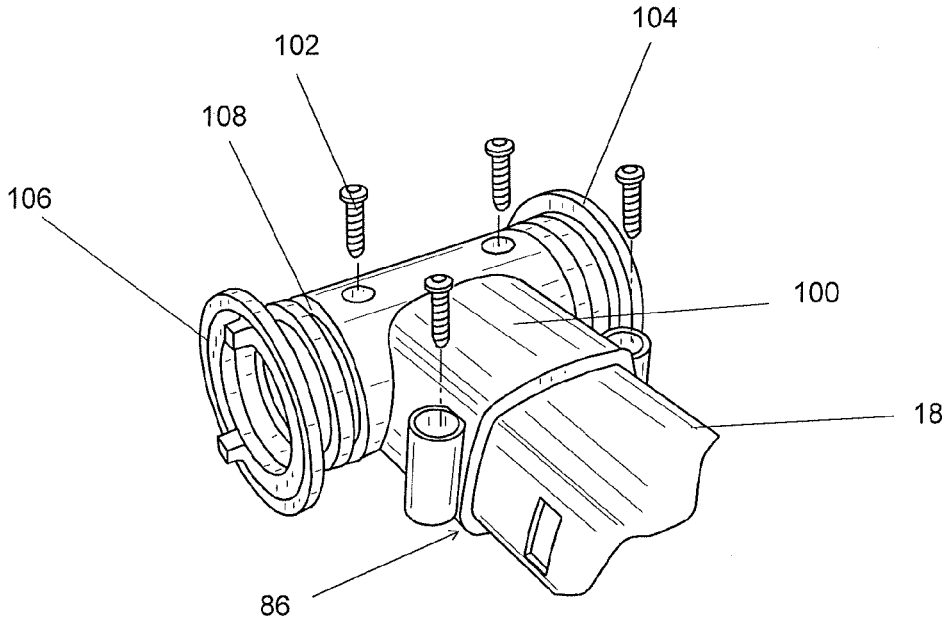
FIG. 11 is a perspective view of a T-member attached to a post, in accordance with the present invention.
Figure 12:
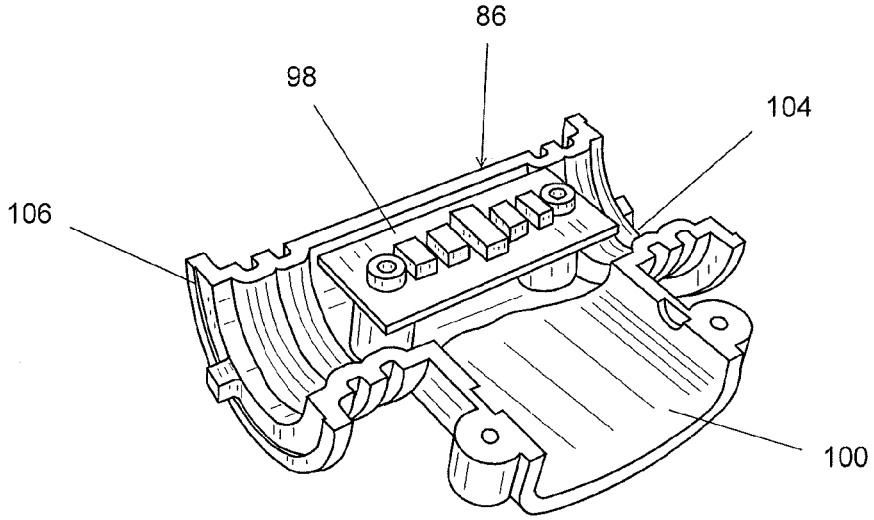
FIG. 12 is a perspective view of a first portion of the T-member, in accordance with the present invention.
Figure 14:
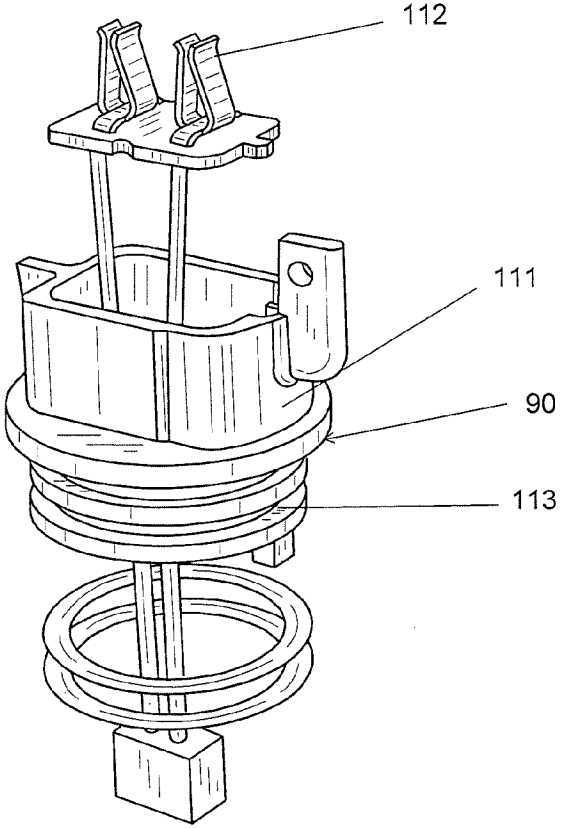
FIG. 14 is a exploded perspective view of a terminal connector of the post connector, in accordance with the present invention.
Figure 13:
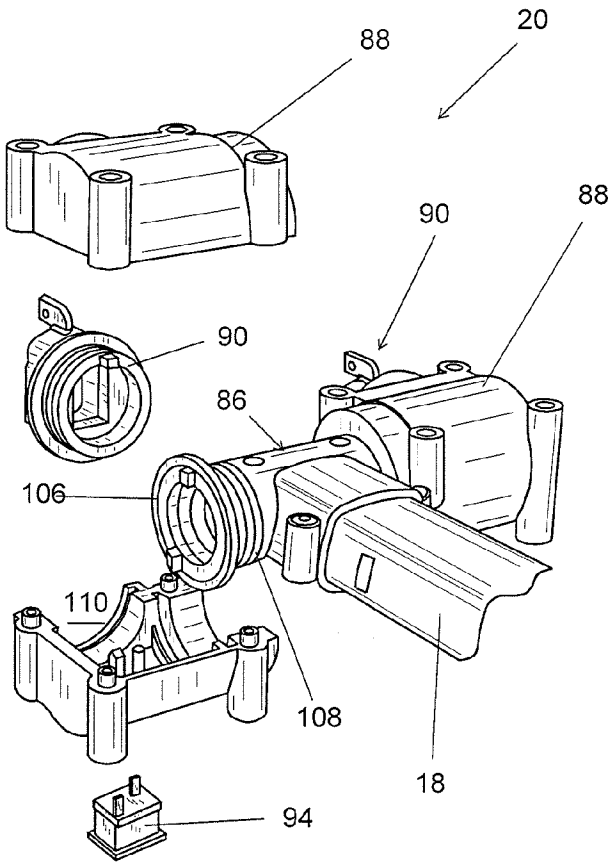
FIG. 13 is a partially exploded perspective view of a post connector attached to the post, in accordance with the present invention.
Figure 15:
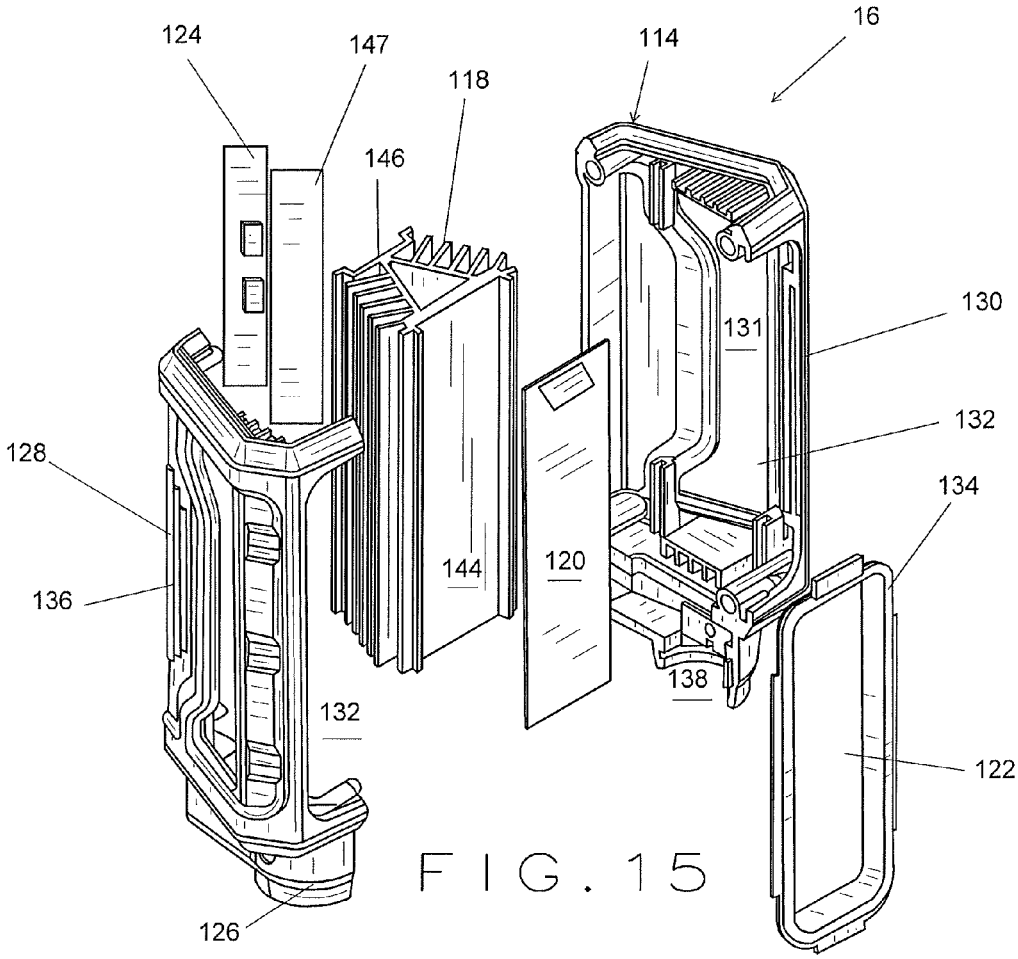
FIG. 15 is an exploded perspective view of a light module, in accordance with the present invention.
Figure 16:
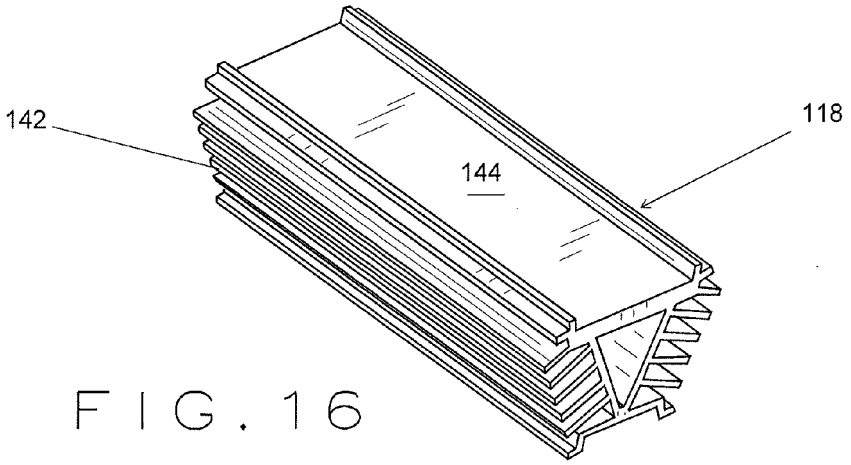
FIG. 16 is a perspective view of a heat sink of the light module, in accordance with the present invention.
Figure 17:
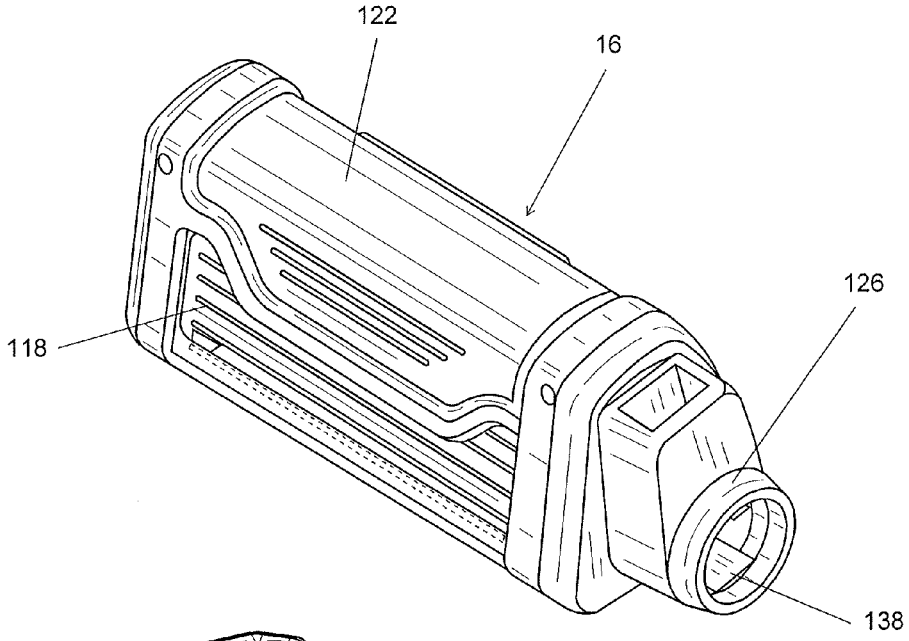
FIG. 17 is a side perspective view of the light module, in accordance with the present invention.
Figure 18:
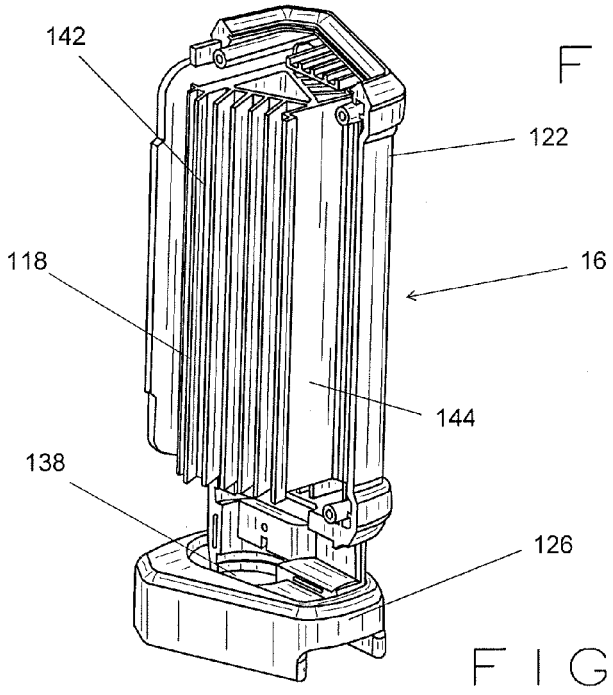
FIG. 18 is a perspective view of the light module with one half of the housing removed, in accordance with the present invention.
Figure 19:
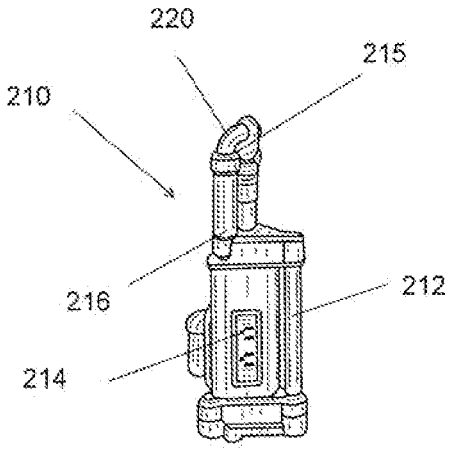
FIG. 19 is a perspective view of an alternate embodiment of a light stand assembly in a lowered position, in accordance with the present invention.
Figure 20:
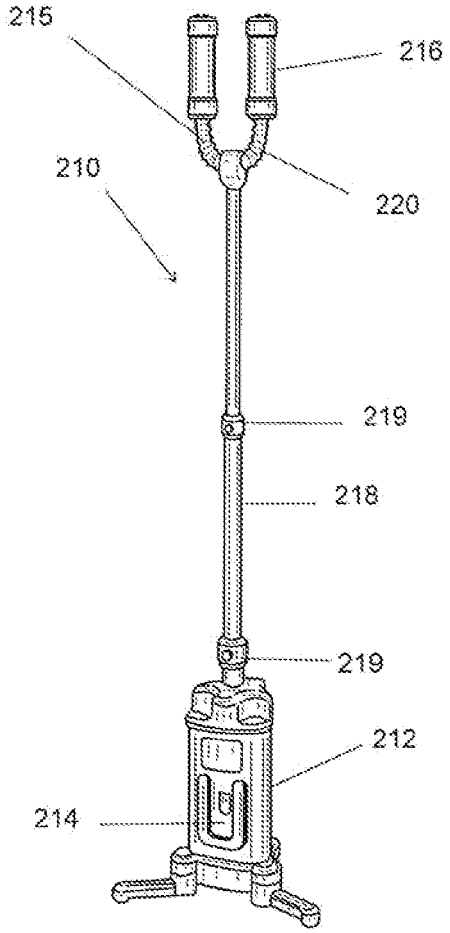
FIG. 20 is a perspective view of an alternate embodiment of the light stand in a raised position, in accordance with the present invention.
Figure 21:
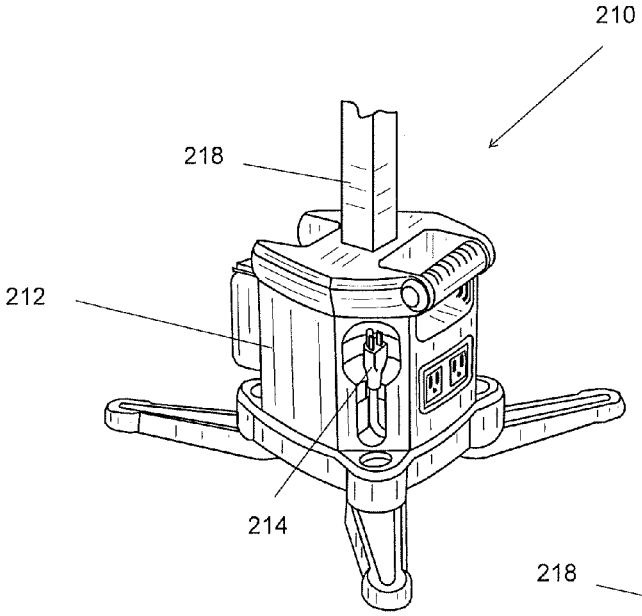
FIG. 21 is a first perspective view of an alternate embodiment of a base of the light stand.
Figure 22:
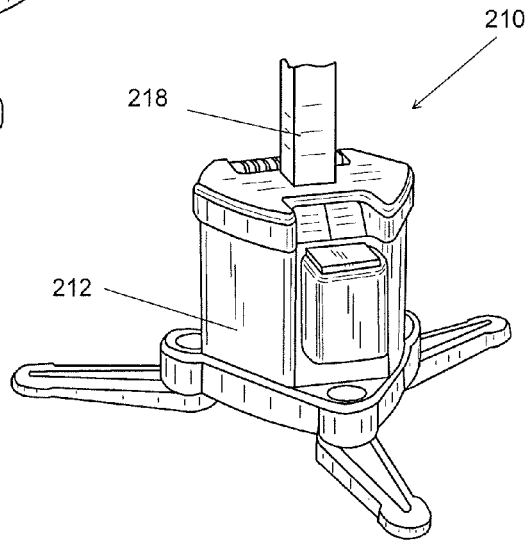
FIG. 22 is a second perspective view of an alternate embodiment of a base of the light stand.
Figure 23:
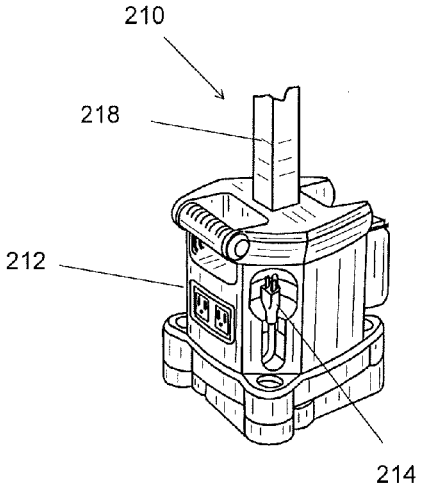
FIG. 23 is a third perspective view of an alternate embodiment of a base of the light stand.
Figure 28:
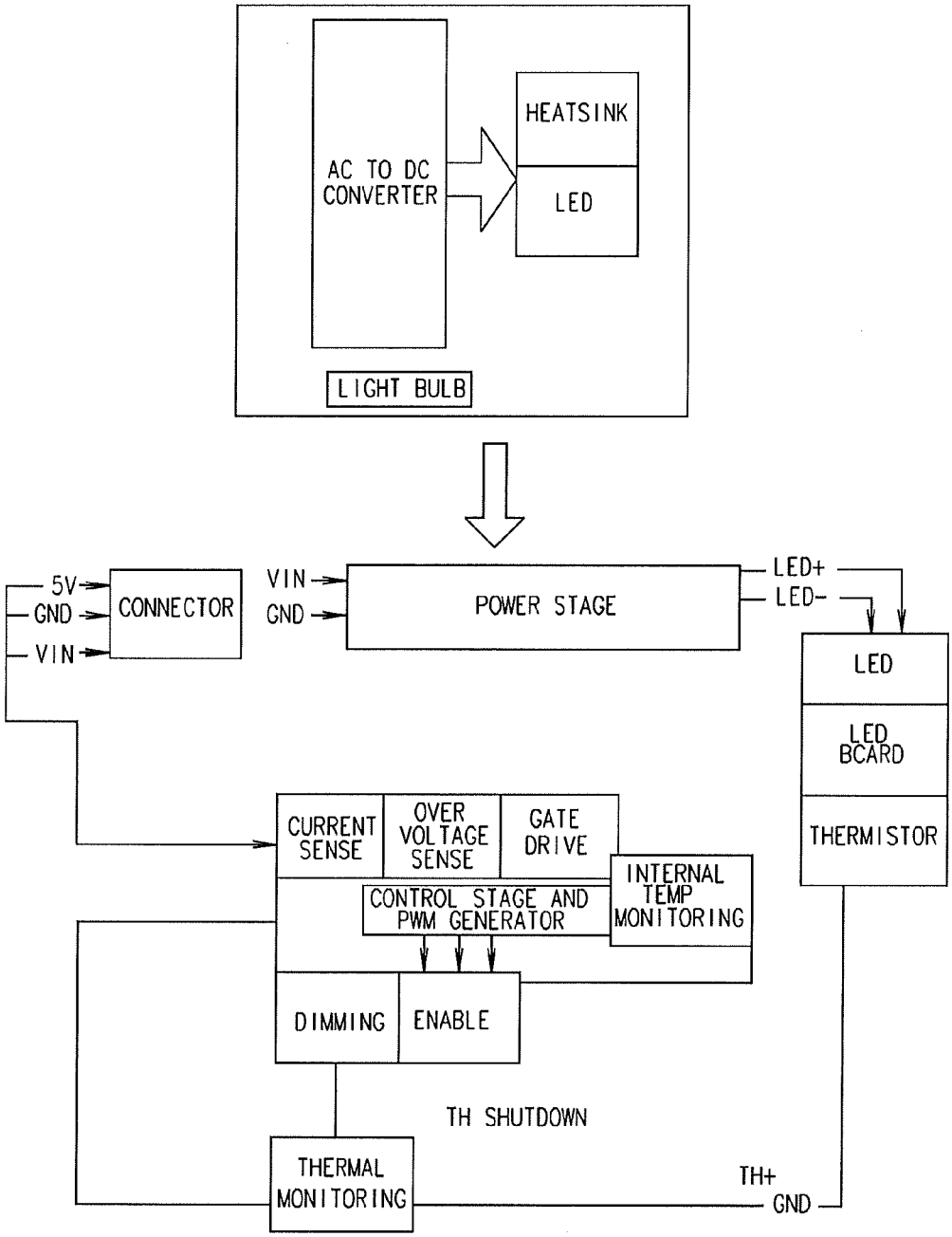
FIG. 28 is a block diagram of an alternate power supply circuit, in accordance with the present invention.

In an alternative embodiment of the invention, as shown in the block diagram of FIG. 28, the DC-to-DC converter may include an analog PWM controller in addition to the power stage. The power stage in this embodiment is used to obtain a constant current supply of power. The PWM controller is used to control the amount of power supplied to the LED board. In this embodiment, the control unit of FIG. 8 is used only for thermal monitoring and dimming control. Thus, the other functions described above such as over-current sensing, over-voltage sensing, internal temperature monitoring, will be handled directly by the PWM controller. The PWM controller also includes an enable/disable input, which is used to cut off supply of power through the DC-to-DC converter, and a dimming input, which is used to control the flow and amount of current being supplied. The PWM controller performs the dimming function by modifying the duty cycle of the PWM current supplied to the LED board. Upon detecting an over-temperature condition, the control unit can either send a disable signal to the PWM controller to cut off power, or send a dimming signal to slow the flow of current through the PWM controller. The PWM controller also receives current, voltage, and temperature signals from the light module and/or the base module and controls the supply of power accordingly. The PWM controller communicates with the power stage to control the PWM duty cycle of the power supply through a gate drive interface. This embodiment provides the advantage of providing intelligence for controlling some aspects of the light module within the light module itself.

FIGS. 19-23 show an alternate embodiment of the light stand assembly 200. For ease of understanding, components common between the first and second embodiments are identified with similar reference numbers, except the reference numbers in the second embodiment include a "200" prefix. For example, the base of the first embodiment is identified as 10, while a second embodiment with a similar base device is identified as 210. Naturally, any new components are identified with unique reference numbers.

Similar to the embodiment of FIGS. 1-18, a light stand assembly 210, includes a base assembly 212 having a power supply circuit 214 operatively connected to a pair of light modules 216. An adjustable post assembly 218 attaches to the base assembly 212 and is configured for variable movement and securement of the light modules 216 between a lowered position (FIG. 19), a raised position (FIG. 20), and any position in between. An adjustable post connector 220 attaches to the upper end of the post assembly 218, and is configured for detachable connection with the light modules 216.

An alternate embodiment of the post connector 220 includes two flexible elbows 215 that are integrally coupled to two light modules 216. The flexible elbows 215 allow the light modules 216 to be pointed in any desired direction. Furthermore, in the storage position, the flexible elbows 216 allow the light modules 216 to bend downwardly within corresponding slots provided on the base assembly to accommodate the light modules 216.

Figure 24:
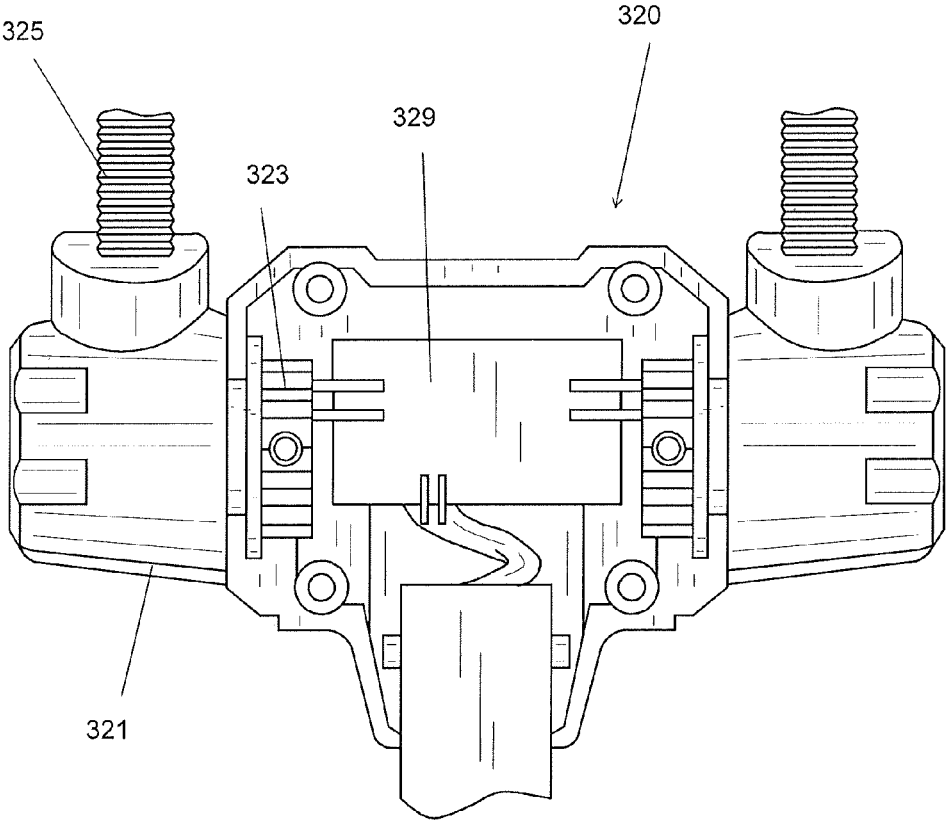
FIG. 24 is a partial cross-section view of an alternate post connector.

FIG. 24 depicts another alternate post connector 320. In this embodiment, the post connector 320 includes two rotating knobs 321 with two cylindrical portions 323. The rotating knobs 321 are pivotable along a single plane. Two flex necks 325 are attached through the cylindrical portions of the rotating knobs 321. A circuit board 329 in the post connector 320 operatively connects to the post assembly 318 and distributes the power through a pair of wires through the two flexible necks 325. The circuit board 329 may include a control unit for thermal control of the light module 316. A light base is provided on top portions of the flexible necks 325. Each light base includes a universal interface and electrical circuitry that connects the pair of wires in the flex neck 325 to the universal interface. The universal interface of the light base is designed to pair with a corresponding interface of the light module 316. The universal interface of the light base includes power pins to provide power to the light module 316. The universal interface may also include one or more control pins for communicating controls signals between the light module 316 and the power supply circuit 314. Each light base may also include control circuitry (later referred to as the "latch circuit") that controls, and in some circumstances shuts off, supply of power to the light module through the universal interface. It is noted that the universal interface of the light base couple to compatible interfaces of other electrical systems. For example, a fan designed with a matching interface may be mounted and coupled to the light stand and powered through the universal interface. The rotating knobs 321 are pivotable along a single plane via detent bearings that engage spring ball detents. This allows the rotating knobs to rotate within a predetermined range of motion along the plane.

The post assembly 218 includes alternate push-button type latches 219. The push-button is integrally connected to a lever that pivots around a pivot point provided within the housing. A pin is provided on the other end of the lever such that, when the button is pressed by the user, rotation of the lever around the pivot point engages and lifts up the pin. The pin in turn disengages a through-hole provided on the inner rod, allowing the inner rod to slide through the middle rod. The engagement holes are provided at predetermined positions on the inner rod to lock/unlock the latch at various positions. There could be multiple holes in the poles allowing the light to be positioned at various heights.

Changes can be made in the above constructions without departing from the scope of the invention, it is intended that all matter contained in the above description or shown in the accompanying drawings shall be interpreted as illustrative and not in a limiting sense.

What is claimed is:

1. A light module for a light assembly, comprising:

a housing having a generally triangular prism shape and defining a chamber and two side openings;

a heat sink mounted within the housing chamber and partially exposed via the two side openings to surrounding atmosphere for heat transfer;

an LED array mounted to the heat sink for heat transfer from the LED array to the heat sink;

a light cover mounted to the housing to allow illumination from the light to pass therethrough;

a light interface mounted to the housing and operatively connected to the LED array, the light interface configured for detachable mating with the light stand assembly; and a convertor mounted to the heat sink and operatively connected to the light interface.

2. The light module of claim 1, the heat sink comprising:

a first mounting surface for mating with the LED array;

a second mounting surface for mating with the converter; and a plurality of cooling fins extending between the first mounting surface and the second mounting surface, thereby forming a generally triangular prism.

3. The light module of claim 1, the LED array comprising a plurality of light emitting diodes configured to emit light in a range of about 1500 lumens to about 1800 lumens.

4. The light module of claim 1, the heat sink being configured to maintain the temperature of the LED array below about 90° Celsius.

5. The light module of claim 1, the heat sink being configured to transfer heat from the LED array and the convertor to the atmosphere, so that the temperature of the heat sink is 60° C. or below during operation.

6. The light module of claim 1, the heat sink being a size of about 130 mm×50 mm×57 mm.

7. The light module of claim 1, the heat sink being a weight of about 375 g.

8. The light module of claim 1, the convertor comprising a DC-to-DC convertor.

9. The light module of claim 1, further comprising a thermally conductive and electrically insulating material mounted between the convertor and the heat sink.

10. A detachable light module, comprising:

a housing having an interface configured for detachable mating with a power source, the housing having a generally triangular prism shape and defining a chamber and two side openings;

a heat sink mounted within the housing chamber and partially exposed via the two side openings for heat transfer from the heat sink to a surrounding atmosphere;

a light mounted to the heat sink for heat transfer from the light to the heat sink, and operatively connected to the interface;

a light cover mounted to the housing to allow illumination from the light to pass therethrough; and a convertor mounted to the heat sink and operatively connected to the light interface.

11. The detachable light module of claim 10, the heat sink comprising:

a first mounting surface for mating with the light;

a second mounting surface for mating with the converter; and a plurality of cooling fins extending between the first mounting surface and the second mounting surface, thereby forming a generally triangular prism.

12. The detachable light module of claim 10, the light comprising a plurality of light emitting diodes configured to emit light in a range of about 1500 lumens to about 1800 lumens.

13. The detachable light module of claim 10, the heat sink being configured to maintain the temperature of the light below about 90° Celsius.

14. The detachable light module of claim 10, the heat sink being configured to transfer heat from the light and the convertor to the surrounding atmosphere, so that the temperature of the heat sink is 60° C. or below during operation.

15. The detachable light module of claim 10, the heat sink being a size of about 130 mm×50 mm×57 mm.

16. The detachable light module of claim 10, the heat sink being a weight of about 375 g.

17. The detachable light module of claim 10, the convertor comprising a DC-to-DC convertor.

18. The detachable light module of claim 10, further comprising a thermally conductive and electrically insulating material mounted between the convertor and the heat sink.

* * * * *